US007874712B2

(12) United States Patent
Arceneaux

(10) Patent No.: US 7,874,712 B2
(45) Date of Patent: Jan. 25, 2011

(54) SYSTEMS AND METHODS FOR ACCESSING INTERNAL COMPONENTS OF A SUSPENDED LIGHT FIXTURE

(75) Inventor: Chad Everett Arceneaux, Newnan, GA (US)

(73) Assignee: Cooper Technologies Company, Houston, TX (US)

( * ) Notice: Subject to any disclaimer, the term of this patent is extended or adjusted under 35 U.S.C. 154(b) by 287 days.

(21) Appl. No.: 12/179,197

(22) Filed: Jul. 24, 2008

(65) Prior Publication Data

US 2010/0020549 A1 Jan. 28, 2010

(51) Int. Cl.
*F21V 21/38* (2006.01)

(52) U.S. Cl. ..... 362/391; 362/375; 362/404; 362/147; 362/374

(58) Field of Classification Search ..... 362/147, 362/404, 407, 408, 374–375, 391, 418, 362; 24/136 R, 115 F, 115 R, 122.6, 136 A, 134 L, 24/115 M
See application file for complete search history.

(56) References Cited

U.S. PATENT DOCUMENTS 5,550,725 A 8/1996 Shemitz et al.
6,022,129 A * 2/2000 Tang ..... 362/404
6,843,581 B2 1/2005 Mier-Langner et al.
7,153,167 B1 * 12/2006 Switzer ..... 439/642
7,172,332 B2 * 2/2007 Mobarak et al. ..... 362/649
7,282,728 B2 10/2007 Culbert
2003/0026094 A1 2/2003 Plourde et al.
2006/0133077 A1 6/2006 Roa
2007/0147053 A1 * 6/2007 Gagne et al. ..... 362/404
2008/0112172 A1 5/2008 Pahl

* cited by examiner

*Primary Examiner*—Jong-Suk Lee
*Assistant Examiner*—Robert J May
(74) *Attorney, Agent, or Firm*—King & Spalding LLP

(57) ABSTRACT

A suspended light fixture includes a housing having first and second members configured to engage one another in a closed position and disengage from one another in an open position. For example, one member can include a cover, and the other member can include a housing body. The housing contains at least one internal component coupled to one of the members. The first member is configured to receive at least one cable. At least one cable gripper is coupled to the first member. Each cable gripper is slidable along a corresponding cable in a first direction and configured to only allow movement of the cable gripper in a second, opposite direction, upon operation of a mechanism. Movement of the cable grippers in the first direction causes corresponding movement of the first member, towards the open position. In the open position, the internal components are accessible for maintenance or another activity.

19 Claims, 3 Drawing Sheets

SYSTEMS AND METHODS FOR ACCESSING INTERNAL COMPONENTS OF A SUSPENDED LIGHT FIXTURE

TECHNICAL FIELD

The invention relates generally to suspended light fixtures and more particularly to systems and methods for accessing internal components of a suspended light fixture.

BACKGROUND

A luminaire is a system for producing, controlling, and/or distributing light for illumination. For example, a luminaire can include a system that outputs or distributes light into an environment, thereby allowing certain items in that environment to be visible. Luminaires are sometimes referred to as "light fixtures."

A suspended light fixture is a light fixture that is suspended from an overhead location, such as a ceiling, by one or more cables. A typical suspended light fixture includes electrical components contained within a housing, a lamp socket coupled to the electrical components, a reflector or diffuser mounted to the lamp housing, and one or more cables connecting the housing to an overhead location. The lamp socket is configured to receive a light-emitting element, such as a lamp, a light-emitting diode ("LED"), or a bulb.

A person must be able to access the internal electrical components of the light fixture to perform routine maintenance on the light fixture and/or to troubleshoot failures of the light fixture. For example, access to the internal components may be necessary to replace a faulty electrical component with a working electrical component. To access the internal electrical components of a conventional suspended light fixture, a person has to climb a ladder or ride a bucket truck to the overhead location of the light fixture and open the housing using a screwdriver or other tool. In some instances, the person had to disconnect the light fixture from the overhead location to open the housing. This process is time consuming and cumbersome. In addition, this process is dangerous because the person could accidentally drop the light fixture from the overhead location while disconnecting the light fixture, opening the housing, and/or accessing the electrical components.

Therefore, a need exists in the art for an improved means for accessing internal components of a light fixture. In particular, a need exists in the art for efficient, user-friendly systems and methods for accessing internal components of a suspended light fixture. In addition, a need exists in the art for such systems and methods to be safe.

SUMMARY

The invention provides an improved method and device for accessing internal components of a suspended light fixture. In particular, the invention provides efficient, user-friendly, and safe systems and methods for accessing internal components of the suspended light fixture.

A suspended light fixture can include a lamp housing having a first member and a second member that are configured to engage one another in a closed position and disengage from one another in an open position. For example, one of the members can include a cover, and the other member can include a body. The lamp housing can be configured to house at least one internal component, such as a ballast tray, a power tray, or another electrical or non-electrical component. These components can be coupled to one of the members.

The first member can be configured to receive at least one cable. Each cable typically is an elongated member configured to support the weight of at least a portion of the light fixture. For example, each cable can include at least one metallic and/or non-metallic rope, chain, pendant, cord, solid rod, and/or wire, such as wire rope commonly referred to as "aircraft cable."

At least one cable gripper can be coupled to the first member. Each cable gripper is slidable along a corresponding cable in a first direction. For example, each cable gripper can be slidable along the cable in a direction away from the second member. Each cable gripper can prevent movement of the cable gripper in a second, until the operation of a mechanism. For example, the mechanism can include a knurled safety nut or another device associated with the cable gripper or incorporated within the cable gripper that can be operated to allow movement of the cable gripper in the second direction.

Movement of the cable gripper in the first direction can cause corresponding movement of the first member towards the open position. In the open position, the internal components are accessible for maintenance or another activity. For example, a person can operate the cable gripper with a single hand.

A stop member can be attached to the cable and configured to support at least a portion of the weight of the light fixture. For example, the stop member can be disposed below at least one of members, engaging and supporting a surface thereof. The cable gripper can prevent potential energy, such as gravity, from causing the internal components coupled to the first member from falling when in the open position. Thus, the stop member and the cable gripper can allow the internal components of the light fixture to be efficiently, easily, and safely accessed for maintenance or some other purpose.

These and other aspects, features and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the present invention and the advantages thereof, reference is now made to the following description, in conjunction with the accompanying figures briefly described as follows.

DETAILED DESCRIPTION OF EXEMPLARY EMBODIMENTS

The invention is directed to systems and methods for accessing internal components of a suspended light fixture. In particular, the invention provides efficient, user-friendly, and safe systems and methods for accessing internal components of a suspended light fixture. For example, the internal components can include one or more electrical components, such as a ballast tray or a power tray.

Figure 1:
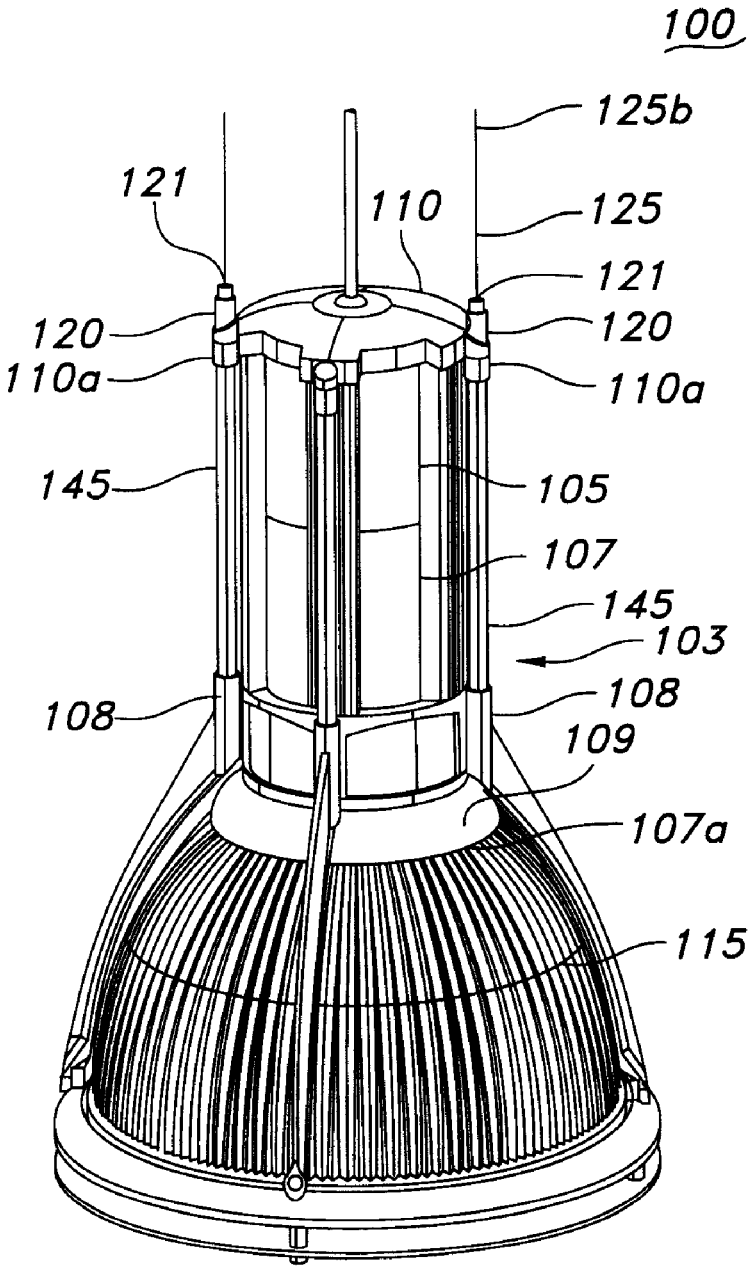
FIG. 1 is an elevational view of a system for accessing internal components of a suspended light fixture, according to certain exemplary embodiments.
Figure 2:
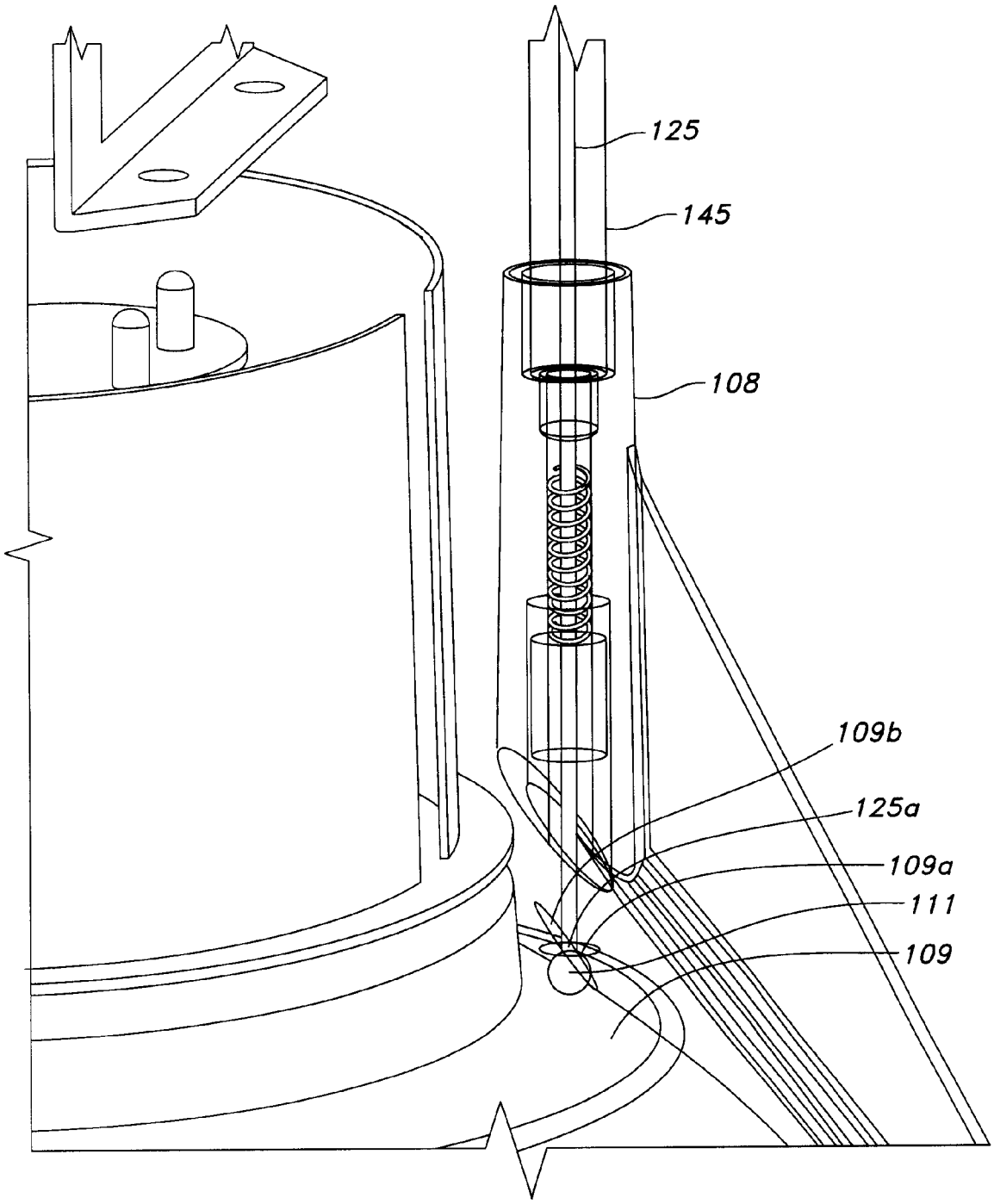
FIG. 2 is a partial elevational view of the system of FIG. 1, with an interior end of a cable being visible within the suspended light fixture, according to certain exemplary embodiments.
Figure 3:
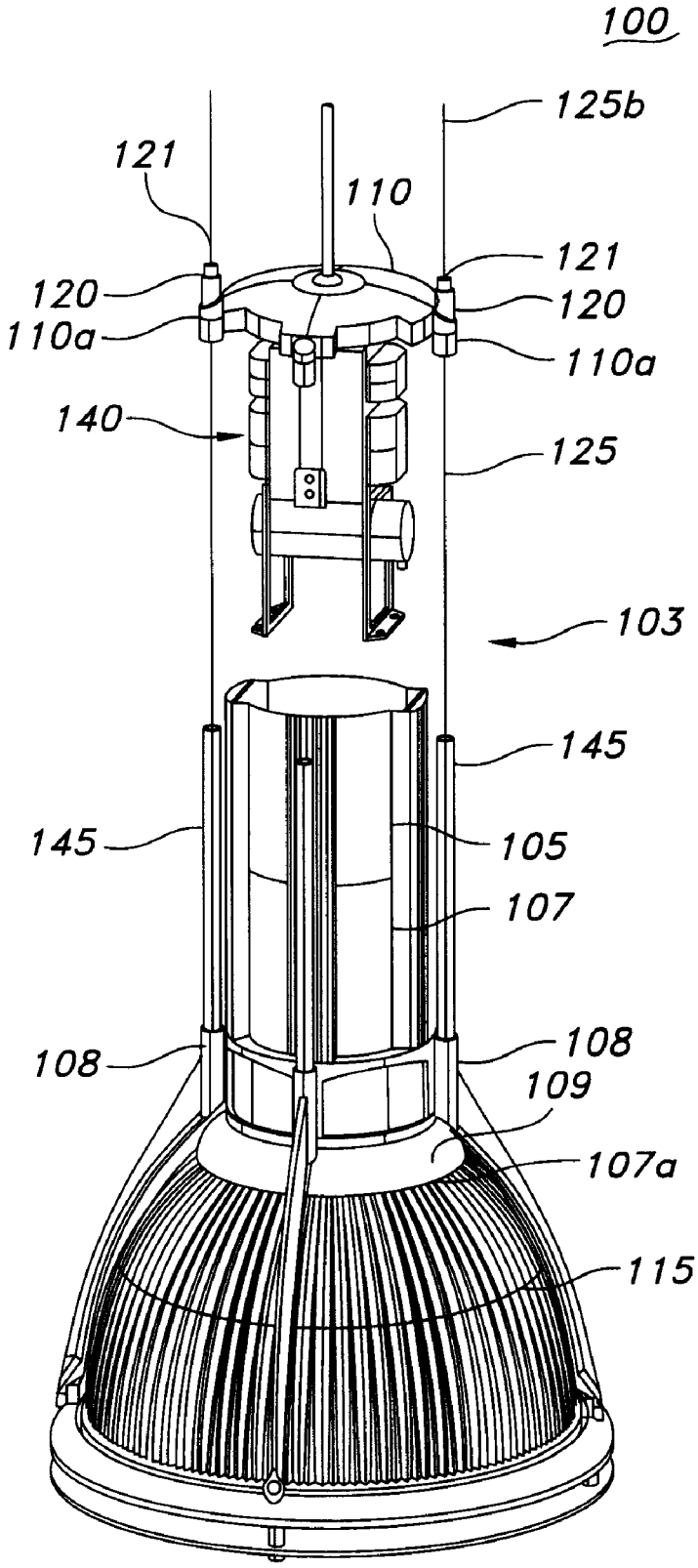
FIG. 3 is a partial elevational view of the system of FIG. 1, with the light fixture in an open position, according to certain exemplary embodiments.

Turning now to the drawings, in which like numerals indicate like elements throughout the figures, exemplary embodiments of the invention are described in detail. FIG. 1 is an elevational view of a system 100 for accessing internal components of a suspended light fixture 103, according to certain exemplary embodiments. FIG. 2 is a partial elevational view of the system 100 of FIG. 1, with a bottom end 125*a* of a cable 125 being visible within the light fixture 103, according to certain exemplary embodiments. FIG. 3 is a partial elevational view of the system 100 of FIG. 1, with the light fixture 103 in an open position, according to certain exemplary embodiments.

With reference to FIGS. 1-3, the light fixture 103 is an electrical device configured to create artificial light or illumination. For example, the light fixture 103 can be configured to create such artificial light or illumination via one or more incandescent lamps, fluorescent lamps, high intensity discharge (HID) lamps, pulse start metal halides, high pressure sodium lamps, compact fluorescent lamps, and/or light-emitting diodes (not shown). The light fixture 103 is configured to be suspended from an over-head location, such as a ceiling (not shown), via one or more cables 125.

Each cable 125 is an elongated member configured to support the weight of at least a portion of the light fixture 103. For example, each cable 125 can include at least one metallic and/or non-metallic rope, chain, pendant, cord, solid rod, and/or wire, such as wire rope commonly referred to as "aircraft cable." In the exemplary embodiment illustrated in FIGS. 1 and 2, two cables 125 disposed proximate opposite vertical sides of a housing 105 of the light fixture 103 are used to suspend the housing 105 from the overhead location. A person of ordinary skill in the art having the benefit of the present disclosure will recognize that other numbers of cables 125 may be used in certain alternative exemplary embodiments. For example, a single cable 125 or more than two cables 125 may be used in certain alternative exemplary embodiments. In a single cable 125 embodiment, for example, the cable 125 can extend substantially through a center of the housing 105, with the components 140 disposed substantially around the cable 125. For example, the cable 125 can be disposed within a hollow tube about which the components 140 are disposed. As described in more detail below, movement of at least one cable gripper 120 along each cable 125 causes corresponding movement of at least a portion of the housing 105 and/or the components 140, providing toolless access to the components 140 for maintenance or other purposes.

Each cable 125 has a bottom end 125*a* disposed within the interior of the fixture 103 and a top end 125*b* coupled to the overhead location. Although illustrated in substantially vertical orientations, a person of ordinary skill in the art having the benefit of the present disclosure will recognize that each of the cables 125 may have any orientation, such as an angular orientation or a horizontal orientation, in certain alternative exemplary embodiments.

The housing 105 includes a body member 107 configured to house one or more components 140, such as a ballast tray or a power tray, wiring, and electrical connectors. The components 140 are connected to a lamp socket (not shown) configured to receive a light-emitting element (not shown), such as an incandescent lamp, a fluorescent lamp, a high intensity discharge (HID) lamp, a pulse start metal halide, a high pressure sodium lamp, a compact fluorescent lamp, and/or a light-emitting diode. For example, electrical wires and/or quick-connect connections (not shown) may connect the components 140 to the light-emitting element. The components 140 are configured to supply power to the lamp socket, to energize the light-emitting element. An optic element 115, such as a reflector, a diffuser, or a shade, is mounted to the housing 105, substantially around the lamp socket. The optic element 115 is configured to reflect or diffuse light from the lamp into a desired environment.

The components 140 are connected to a cover 110 of the housing 105. A bottom end of the cover 110 is configured to engage a top end of the body member 107 when the light fixture 103 is in a closed (normal) operating position, as illustrated in FIGS. 1-2. Thus, when the light fixture 103 is in the closed operating position, the components 140 are disposed within the housing 105.

Each cable 125 extends from the overhead location, through a corresponding protruding side member 110*a* of the cover 110, through a leg 108 of the body member 107, and through a support member 109 of the body member 107. The support member 109 includes an end 107*a* of the body member 107 and is disposed substantially around the optic 115. A stop member 111, coupled to the bottom end 125*a* of the cable 125, is configured to engage an interior surface 109*a* of the support member 109.

In certain exemplary embodiments, the stop member 111 is substantially spherically shaped, with a diameter larger than a diameter or width of the cable 125. The diameter of the stop member 111 also is larger than a diameter or width of a support member aperture 109*b* through which the cable 125 extends. The stop member 111 is configured to support the weight of at least a portion of the light fixture 103. When the light fixture 103 is installed, the support member 109 rests on the stop member 111, suspended from the overhead location. In certain exemplary embodiments, the stop member 111 is a die-cast or swaged member.

In certain alternative exemplary embodiments, the stop member 111 has a different geometry, such as a substantially square, rectangular, or oval. Alternately, the stop member 111 is replaced by other means for mechanically supporting the light fixture 103 on the cables 125. For example, such means may include wedging each cable 125 using a screw, wedge, nail, snap, clip, collar, or pin, tying a knot in the cable 125, and/or routing the cable 125 within the housing 105 and back out of the housing 105 to the overhead location, towards, through, or to the protruding side member 110*a*, in a generally "U"-shaped orientation.

In certain exemplary embodiments, a tubular member 145 extends between each protruding side member 110*a* and its corresponding leg 108, with a portion of the cable 125 extending therethrough. The tubular member 145 can be both decorative and functional. For example, the tubular member 145 includes an aesthetically pleasing support configured to maintain a mechanical relationship between each protruding side member 110*a* and its corresponding leg 108. In certain exemplary embodiments, each tubular member 145 is threadably attached to its corresponding leg 108. A person of ordinary skill in the art having the benefit of the present disclosure will recognize that many suitable means exist for attaching the tubular members 145 and legs 108. For example, in certain alternative exemplary embodiments, the tubular members 145 and legs 108 are screwed, nailed, snapped, clipped, and/or pinned together.

A cable gripper 120 is slidably coupled to each cable 125, proximate its corresponding protruding side member 110*a*. Each cable gripper 120 is a device configured to slide along the cable 125 in a first direction, locking out movement in a second, opposite direction. For example, the cable grippers 120 depicted in FIGS. 1 and 2 are configured to slide along the cables 125 in a direction towards the overhead location and away from the bottom end 125*a* of the cable 125, locking out movement in the opposite, downward direction. Each cable gripper 120 includes a disengaging mechanism that is selectively operable to overcome the lock-out feature, thereby allowing a person to move the cable gripper 120 in the second direction.

A person of ordinary skill in the art having the benefit of the present disclosure will recognize that many means exist for locking out movement of the cable gripper 120 and for disengaging the lock-out feature. For example, each cable gripper 120 can use ball bearings, conical wedges within a conical body or a sectional portion of a body, and/or a knurled safety nut 121 to perform some or all of these functions. Other suitable means for performing these functions will be readily apparent to a person of ordinary skill in the art having the benefit of the present disclosure. For example, Griplock Systems, Inc. currently offers multiple brands of "gliders," having varying shapes and configurations, that may be used as cable grippers 120 in certain exemplary embodiments.

Each cable gripper 120 is threadably attached to its corresponding protruding side member 110*a*. A person of ordinary skill in the art having the benefit of the present disclosure will recognize that many other suitable means exist for attaching the cable grippers 120 to the protruding side members 110*a*. For example, in certain alternative exemplary embodiments, the cable grippers 120 and protruding side members 110*a* are screwed, nailed, snapped, clipped, pressed, glued, and/or pinned together.

Movement of the cable grippers 120 causes a corresponding movement of the cover 110 and the components 140 attached thereto. Each cable gripper 120 slides upward along its corresponding cable 125 to lift the cover 110 from the body member 107, which is held in place by gravity and prevented from falling by the stop member 111. This movement allows for toolless access to the internal components 140 without disconnecting the housing 105 from the cables 125, the overhead location, or a power source (not shown). The lock-out feature of the cable gripper 120 prevents potential energy, such as gravity, from causing the cover 110 and/or the components 140 from falling during this access. Thus, the internal components 140 are efficiently, easily, and safely accessed.

In the open position depicted in FIG. 3, the cable grippers 120, cover 110, and components 140 are separated from the other parts of the light fixture 103, including the body member 107 and the optic element 115. The cable grippers 120 suspend the cover 110 and the components 140 from the overhead location, along the cables 125. Similarly, the stop member 111 suspends the remaining parts of the fixture 103 from the overhead location, along the cables 125.

To go from the open position of FIG. 3 to the closed position of FIGS. 1 and 2, one or more disengaging mechanisms, such as the knurled safety nuts 121, are engaged to overcome the lock-out feature of the cable grippers 120. Then, the cable grippers 120, and the cover 110 and components 140 coupled thereto, are slid towards the other components of the light fixture 103, until the components 140 are positioned within the body member 107 of the housing, and the cover 110 engages the top end of the body member 107.

In certain alternative exemplary embodiments, the components 140 are not attached to the cover 110. For example, the components 140 can be attached to the optic 115 and/or the lamp socket. In such embodiments, the cable grippers 120 are attached to at least a portion of the housing 105. That portion is not attached to the components 140. The cable grippers 120 can slide along the cables 125, causing corresponding movement of the portion of the housing 105 up and away from the components 140. Such movement allows toolless access to the components 140 for maintenance or other activities.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A system for accessing internal components of a light fixture, comprising:

a lamp housing that houses at least one component, the lamp housing comprising:

a body member having a first end and a second end; and a cover configured to engage the first end of the body member in a closed position and to disengage from the first end of the body member in an open position, the cover being configured to receive a cable therethrough, the at least one component being coupled to the cover; and a cable gripper coupled to the cover and comprising a mechanism, the cable gripper being slidable along the cable in a first direction and being configured to only allow movement of the cable gripper in a second direction upon operation of the mechanism, wherein movement of the cable gripper in the first direction causes movement of the cover towards the open position.

2. The system of claim 1, wherein the cover comprises a protruding member configured to receive the cable therethrough.

3. The system of claim 1, further comprising at least a second cable gripper, wherein the cover is configured to receive at least two cables therethrough, each cable gripper being coupled to the cover and being slidable along one of the cables.

4. The system of claim 1, wherein the at least one component comprises at least one of a ballast tray and a power tray.

5. The system of claim 1, further comprising the cable configured to extend through the cover and the cable gripper.

6. The system of claim 5, further comprising a stop member coupled to the cable and configured to support at least a portion of the weight of the body member when the stop member is disposed below the cover.

7. The system of claim 6, wherein the stop member is positioned proximate the second end of the body member.

8. The system of claim 6, wherein the stop member is positioned within the housing.

9. A system for accessing internal components of a light fixture, comprising:

a lamp housing that houses at least one component, the lamp housing comprising:

a first member; and a second member, the members configured to engage one another in a closed position and to disengage from one another in an open position, the first member being configured to receive a cable therethrough, the component being coupled to one of the members;

a cable gripper coupled to the first member, the cable gripper being slidable along the cable in a first direction and configured to only allow movement of the cable gripper in a second direction along the cable upon operation of a mechanism of the cable gripper, wherein movement of the cable gripper in the first direction causes a corresponding movement of the first member, towards the open position;

the cable configured to extend through the first member and the cable gripper; and a stop member coupled to the cable and configured to support at least a portion of the weight of the light fixture when the stop member is disposed below the first member.

10. The system of claim 9, wherein the electrical component is coupled to the first member.

11. The system of claim 9, wherein the electrical component is coupled to the second member.

12. The system of claim 9, wherein the first member comprises a cover of the lamp housing.

13. The system of claim 9, wherein the first member comprises a body member of the lamp housing, the body member being configured to surround at least a portion of the electrical component when the lamp housing is in the closed position.

14. The system of claim 9, wherein the second member comprises a body member of the lamp housing, the body member being configured to surround at least a portion of the electrical component when the lamp housing is in the closed position.

15. The system of claim 9, wherein the first member comprises a protruding member configured to receive the cable therethrough.

16. The system of claim 9, further comprising a second cable gripper, wherein the first member is configured to receive two cables therethrough, each cable gripper being coupled to the first member and being slidable along one of the cables.

17. The system of claim 9, wherein the electrical component comprises at least one of a ballast tray and a power tray.

18. The system of claim 9, wherein the stop member is positioned proximate a bottom end of the lamp housing.

19. The system of claim 18, wherein the end of the cable extends through an aperture in the bottom end of the lamp housing.

* * * * *